US006145286A

United States Patent [19]

Huber

[11] Patent Number: 6,145,286

[45] Date of Patent: Nov. 14, 2000

[54] APPARATUS FOR STRAPPING PACKAGES

[75] Inventor: Hans Huber, Bremgarten, Switzerland

[73] Assignee: Orgapack GmbH, Dietikon, Switzerland

[21] Appl. No.: 09/201,666

[22] Filed: Dec. 1, 1998

[30] Foreign Application Priority Data

Dec. 1, 1997 [CH] Switzerland ..... 2764/97

[51] Int. Cl.[7] ..... B65B 13/04

[52] U.S. Cl. ..... 53/589; 100/32

[58] Field of Search ..... 53/589, 582; 100/32

[56] References Cited

U.S. PATENT DOCUMENTS

| | | | |
|---|---|---|---|
| 3,851,576 | 12/1974 | Takahishi | 53/589 X |
| 4,011,807 | 3/1977 | Kobiella . | |
| 5,117,615 | 6/1992 | Kung et al. | 53/582 X |
| 5,133,532 | 7/1992 | Figiel et al. | 100/32 |

FOREIGN PATENT DOCUMENTS

| | | |
|---|---|---|
| 0 099 606 | 2/1984 | European Pat. Off. . |
| 0 490 477 | 6/1992 | European Pat. Off. . |
| 40 14 307 | 11/1991 | Germany . |
| 44 25 703 | 1/1995 | Germany . |
| 44 25 908 | 1/1995 | Germany . |
| 688 079 | 9/1994 | Switzerland . |
| 2 205 806 | 12/1988 | United Kingdom . |

*Primary Examiner*—Linda Johnson
*Attorney, Agent, or Firm*—Lowe Hauptman Gopstein Gilman & Berner

[57] ABSTRACT

An apparatus for strapping packages with a band (7) made of weldable plastic comprises a band-supply unit, a band-transporting and -tensioning unit, a closure unit, which is provided as a separate unit and has an abutment plate, and a band-guidance unit and has at least one band clamp (15) with a pivotably mounted clamping part (10). The band clamp (15) is formed by a specific recessed section (14) of the abutment plate (5) and the clamping part (10), a curved operative surface (40) being provided on the clamping part, and the band clamp (15) being self-locking. Selecting the clamping angle W for the band (7) between the clamping part (10) and recessed section (14) to be as large as possible means that it is easier to release the band clamp when the band is tensioned. The apparatus makes it possible for strapping bands to be applied, even with high tensioning, without slipping during the closure operation.

7 Claims, 6 Drawing Sheets

APPARATUS FOR STRAPPING PACKAGES

TECHNICAL FIELD

The invention relates to an apparatus for strapping packages with a band, in particular made of weldable plastic.

BACKGROUND ART

Apparatus for strapping packages with weldable plastic bands, in particular apparatus in which a closure unit is provided as a separate unit, are already known from a number of publications. The closure methods used in such cases are usually welding methods such as friction welding or welding by means of a welding tongue. Thus, for example, CH-A-686 079 discloses an automatic pack-tying apparatus of the abovementioned type having a closure unit, with a first and a second clamping device arranged directly beneath a slide plate which can be moved back and forth. The slide plate absorbs forces when the plastic band is clamped firmly during the closure operation, but moves away, following completion of the closure operation, in order to release the package. The clamping devices are parts which can be moved up and down and have toothed or otherwise suitably shaped top parts for firmly clamping the plastic band between the movable parts and the slide plate. Clamping devices of similar construction are also disclosed in reference publications DE-A-44 25 908, DE-A-40 14 307 and EP-0 490 477.

In the case of all these apparatus, the clamping action of the clamping device is achieved by translatory movement of a clamping part. Apparatus of this type have the disadvantage that, with high tensioning, there is a risk of the plastic band slipping in the firmly clamped state. U.S. Pat. No. 011,807 and EP-A-0 099 606 disclose apparatus with pivotably mounted clamping parts with curved operative surfaces. However, with these apparatus there is also a risk, with high tensioning, of the plastic band slipping in the firmly clamped state.

SUMMARY OF THE INVENTION

The object of the invention is to strap packages with an apparatus which ensures that, even with high tensioning, the strapping band does not slip.

This object is achieved according to the invention with an apparatus in which use is made of band clamps with self-locking, pivotally attached clamping parts. Band clamps with pivotably mounted clamping parts may be designed in a straightforward manner such that they are self-locking and thus produce a clamping force which is proportional to the tensioning. Use is preferably made in this case of clamping parts with curved operative surfaces which, for the purpose of increasing the clamping effect, may be provided with a fine toothing arrangement. The curvature of the operative surfaces of cylindrical, i.e. may be constant radius, but it is also possible to use curves of varying curvature.

In a particularly advantageous configuration, the clamping parts with the curved operative surfaces are designed such that they are also easier to release when the band is tensioned. For this purpose, the band clamps are configured such that the angle range covered by the curved operative surface is selected to be as large as possible and, additionally, the band clamp is formed, in the actual clamping region, such that the point or the zone of engagement of the principally active clamping force shifts, during a pivot movement of the clamping part, on the operative surface of the clamping part in a direction which is counter to the pivot movement.

Further advantageous embodiments of the apparatus according to the invention are explained in more detail in the following description. Such embodiments relate to the arrangement of a closure plate and to the pivotable arrangement of a welding tongue and of a band cutter. Taken as a whole, the inventive features result in a particularly compact and straightforward construction for an apparatus which is intended for strapping packages and also operates reliably and securely with tensioning forces up to 4000 N.

BEST MODE FOR CARRYING OUT THE INVENTION

Figure 1:
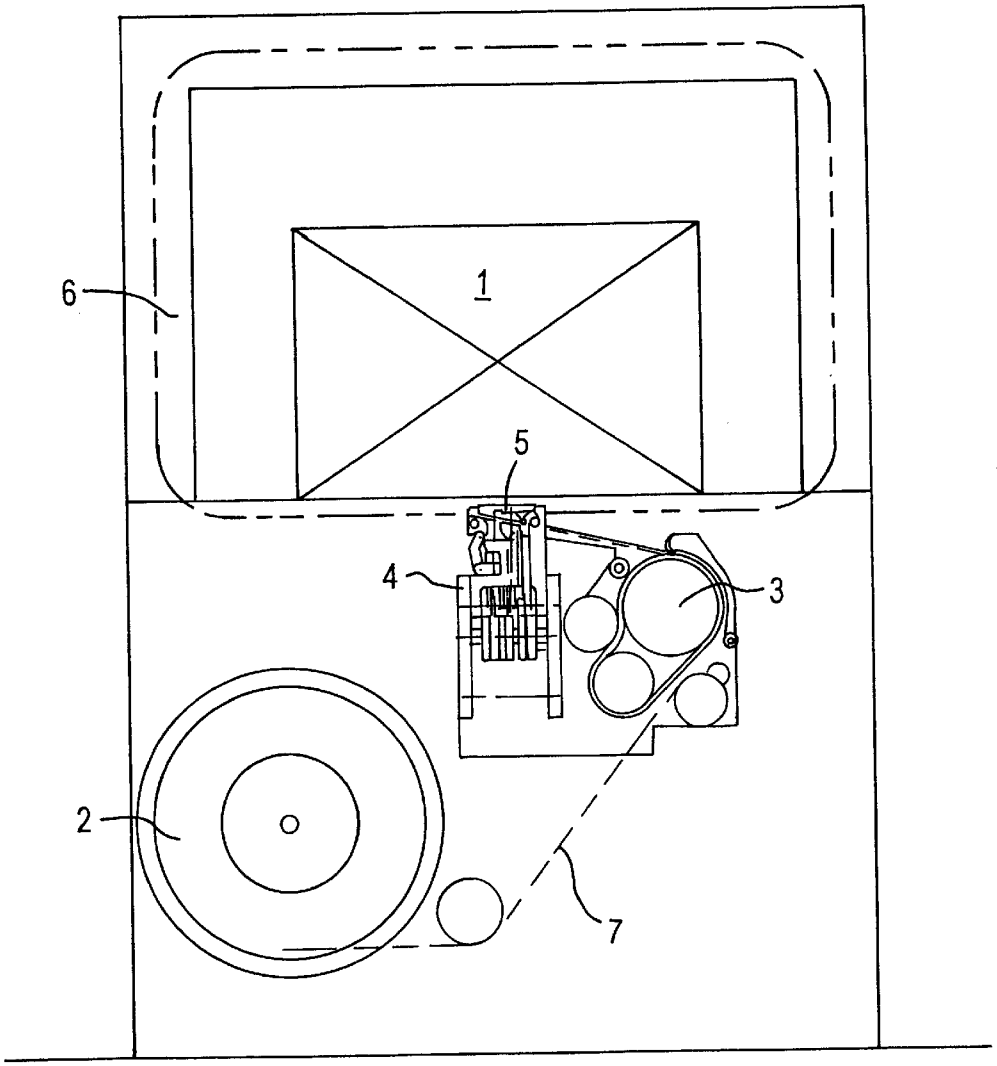
FIG. 1 is a schematic illustration of the strapping apparatus.

FIG. 1 is a schematic illustration of the apparatus for strapping packages 1. The apparatus essentially comprises a band-supply unit 2, a band-transporting and -tensioning unit 3, a closure unit 4, with an abutment plate 5, and a band-guidance unit 6 for guiding the band 7.

Figure 2B:
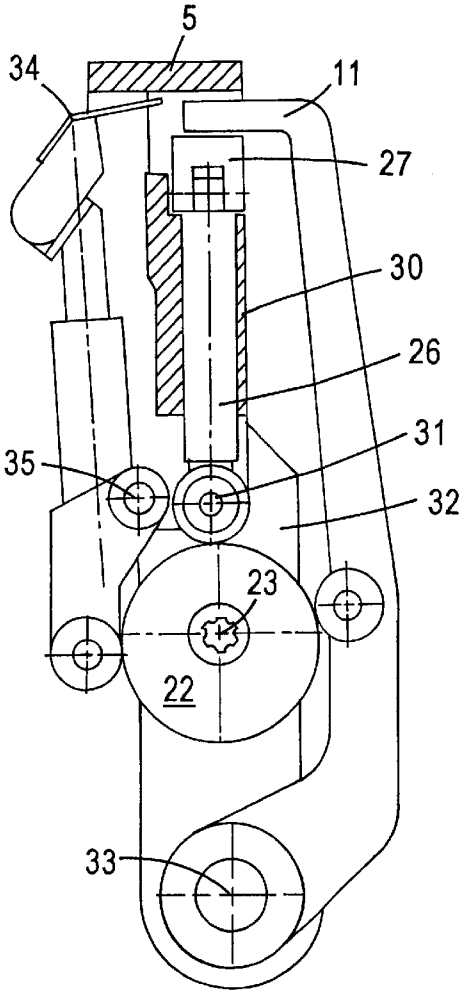
FIGS. 2A and 2B are respective front and side views of shows the closure unit during the advancement of the band.
Figure 2A:
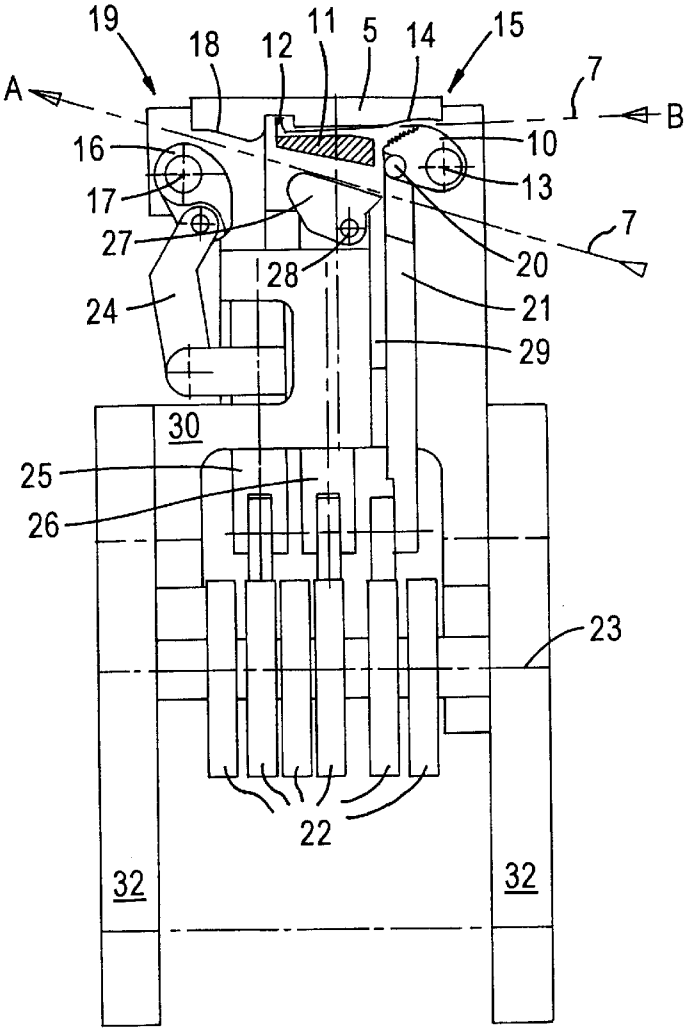

FIGS. 2A and 2B are respective front view and side views of the closure unit 4 during a first phase of the strapping operation, namely, feeding of the band 7.

The band 7 is first of all pushed through the closure unit 4, which is located in the initial position, in direction A by the band-transporting and -tensioning unit 3 and continues to be pushed through the band-guidance unit 6 (see FIG. 1) until, finally, it comes into contact with the band-guidance unit 6 again from direction B. The feed of the band 7 is controlled by a control unit (not illustrated), then takes place initially between the abutment plate 5 and a first clamping part 10 and then between the abutment plate 5 and a band cutter 11, the band cutter 11 bearing the switching mechanism 12 which gives the signal for completing the band feed.

The first clamping part 10, which is mounted pivotably about a first pivot axis 13, forms together with the abutment plate 5, which has a first shaped section 14, a first band clamp 15. A second clamping part 16 is also provided, this being mounted pivotably about a second pivot axis 17 and together with the abutment plate 5, which has a second shaped section 18, forming a second band clamp 19. The first band clamp 15 firmly clamps the pushed-in band end before the band 7 is tensioned by means of the band-transporting and -tensioning unit 3. The second band clamp 19 likewise firmly clamps the tensioned band, at its opposite end, before the band is welded and severed. The band clamps are described in more detail hereinbelow with reference to FIGS. 6 and 7.

The first clamping part 10 is moved by a counter-cutter 20, which is fitted on a slide 21. The slide 21 is driven by one of a plurality of cam discs 22, which are seated on a cam-disc shaft 23. The second clamping part 16 is moved by a link plate 24, which is fitted on a push rod 25. The push rod 25 is also driven by a cam disc 22.

Located between the push rod 25 and the slide 21 is a further push rod 26, which is likewise driven by a cam disc 22 and at the top end of which a closure plate 27 is mounted such that it can be pivoted about an axis of rotation 28 counter to a spring (not illustrated). In the rest position, the closure plate 27 is arranged obliquely with respect to the longitudinal extent of the abutment plate 5 and is retained in this position by a severing cutter 29. The severing cutter 29 is likewise fitted on the further push rod 26. The arrangement of the closure plate 27 in the rest position thus facilitates the introduction of the band 7. In the operating position, the closure plate 27 can be pivoted towards the abutment plate 5 by being moved by the further push rod 26.

The abutment plate 5 is in fixed connection with a pivot housing 30, which is fitted on a main housing 32 such that it can be rotated about an axis. It can be seen from the side views of FIGS. 2B–5B that the band cutter 11, which is also driven by a cam disc 22, is likewise arranged on the main housing 32 such that it can be rotated about a further axis of rotation 33. Furthermore, a welding tongue 34 for fusing the bands is also driven by a cam disc 22 and is mounted on the pivot housing 30 such that it can be rotated about a further axis 35.

The band cutter 11 and welding tongue 34 are driven such that either the band cutter 11 or the welding tongue can be pivoted in beneath the abutment plate 5.

Figure 3B:
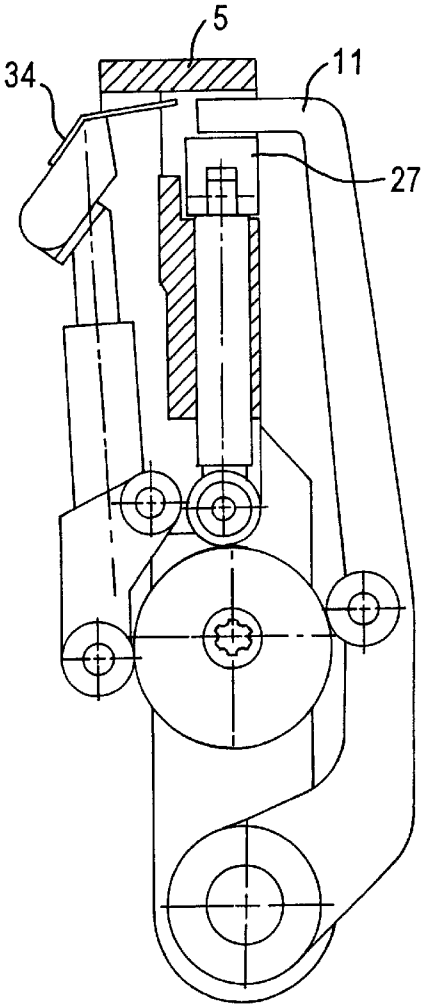
FIGS. 3A and 3B are respective front and side views of shows the closure unit as the band is drawn back and tensioned.
Figure 3A:
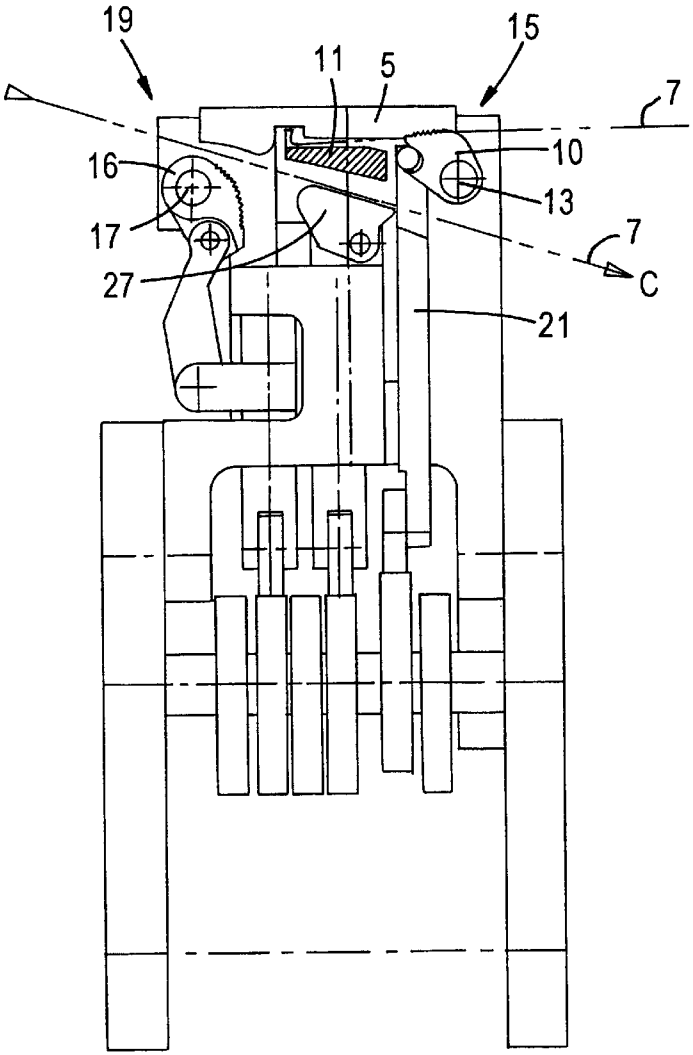

FIGS. 3A and 3B are respective front and side views of the closure unit 4 during a second phase of the strapping operation, in which the band 7 is drawn back and tensioned. The first clamping part 10 is pushed against the first recessed section 14 of the abutment plate 5 by the slide 21 and firmly clamps the start of the band therebetween. Thereafter, the band 7 is drawn back by the band-transporting and -tensioning unit 3 and then tensioned by a tensile force in direction C.

Figure 4B:
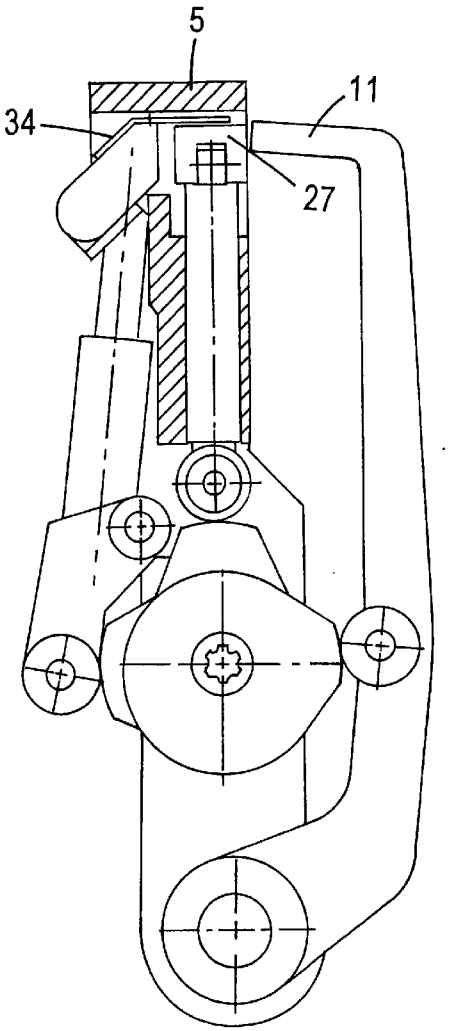
FIGS. 4A and 4B are respective front and side views of shows the closure unit during closure of the band.
Figure 4A:
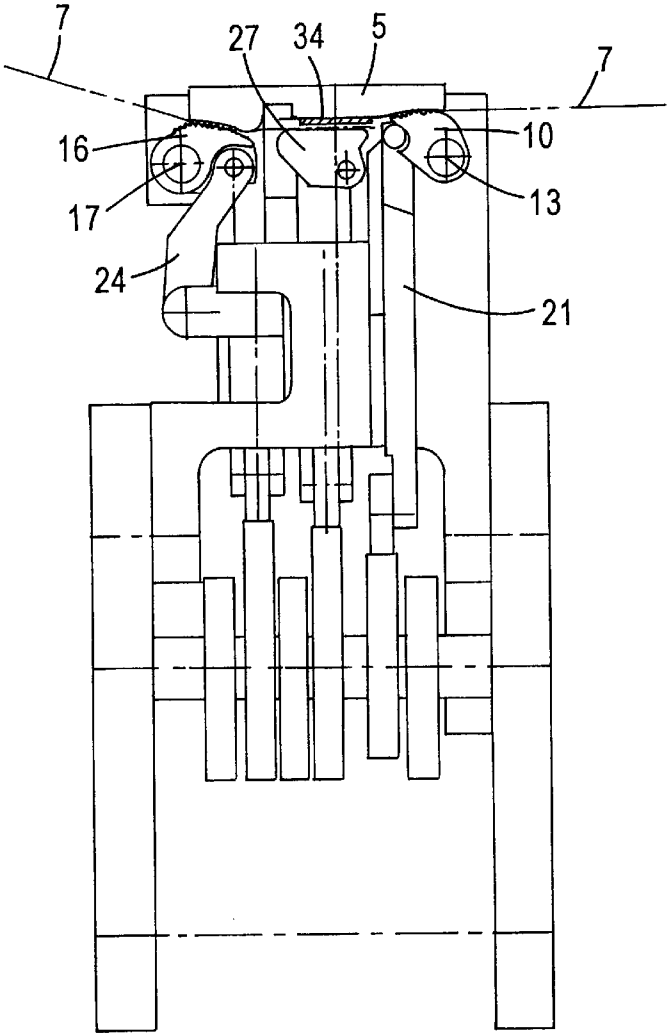

FIGS. 4A and 4B are respective front and side views of the closure unit 4 during a third phase of the strapping operation, in which closure of the band 7 takes place. The second clamping part 16 is pushed against the second recessedly shaped section 18 of the abutment plate 5 by the push rod 25 and firmly clamps the band loop therebetween. After that the band-severing operation and then closure operation take place.

The severing cutter 29 is pushed towards the abutment plate 5 by the further push rod 26 and, in the process, severs the band part leading to the band-supply unit 2. At the same time, the closure plate 27 is rotated about the axis of rotation 28 until it is located parallel to the abutment plate 5. Thereafter, the band and cutter 11 is drawn back respectively pivoted out and the welding tongue 34 is pushed respectively pivoted in, with the result that the welding tongue 34 comes to rest between the two band ends. Thereafter, the further push rod 26 pushes the closure plate 27 towards the abutment plate 5 and thus brings the surfaces of the two band ends into contact with the welding tongue 34, as a result of which the surfaces of the band ends are fused. The closure plate 27 is then drawn back somewhat, the welding tongue 34 is drawn respectively pivoted out and the closure plate 27 is extended towards the abutment plate to the full extent and, in the process, pushes the two band ends together to the full extent. This completes the closure operation.

Figure 5B:
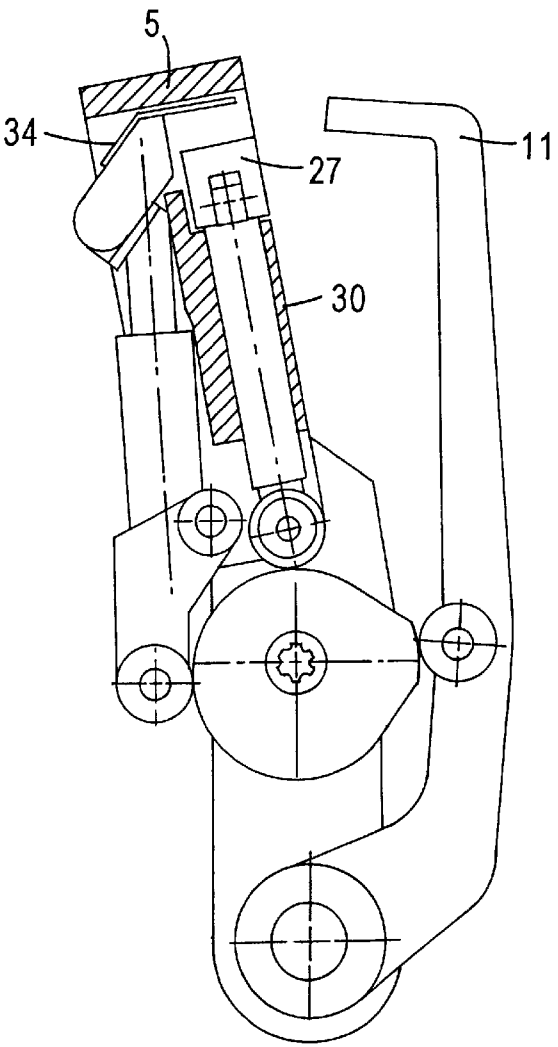
FIGS. 5A and 5B are respective front and side views of shows the closure unit during release of the strapping.
Figure 5A:
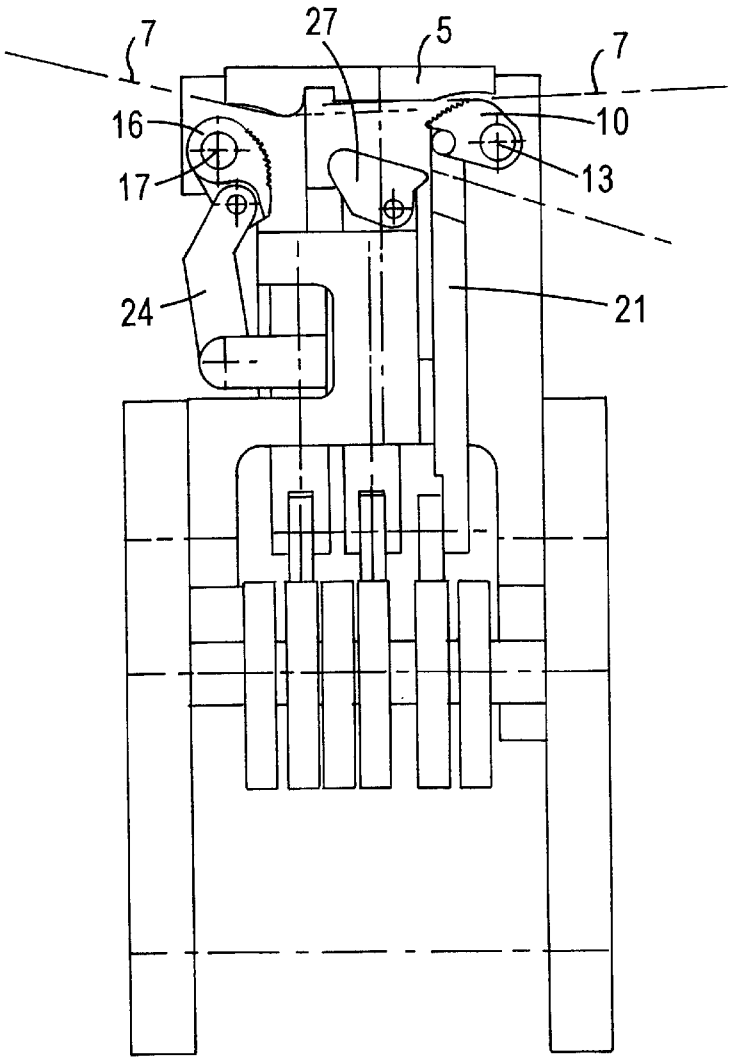

FIGS. 5A and 5B are respective front and side views of the closure unit 4 during the release of the strapping. First of all, the closure plate 27 is drawn back to the full extent and the two band clamps 15, 19 are released. The pivot housing 30 is pivoted away and releases the strapping.

In order to make the apparatus available for a further strapping cycle, the pivot housing 30 is pivoted back again and the band cutter 11 is pushed and/or pivoted in beneath the abutment plate 5 again.

Figure 6:
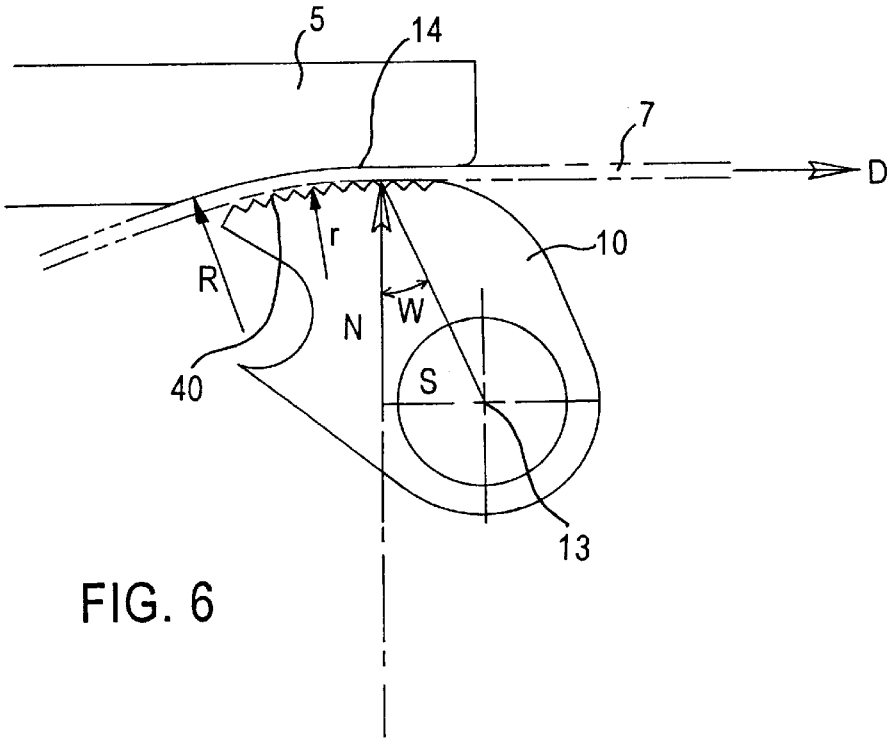
FIG. 6 is an illustration of a band clamp before the beginning of the tensioning operation.

FIG. 6 shows the first band clamp at the beginning of the tensioning operation for the band 7. In this position, the first clamping part 10 is pushed against the first recessed section 14 of the abutment plate 5, by being rotated about the first pivot axis 13, such that the band 7 is clamped in between in a clamping region. The tensile force S acts in direction D. The clamping part 10 has a curved operative surface 40, which may be provided with a toothing arrangement. The first recessed section 14 of the abutment plate 5 has a likewise curved, similarly shaped mating operative surface. In the following, the operative surface 40 is intended to mean that part-surface of the first clamping part 10 on which the clamped-in band 7 rests.

The first clamping part 10 and the corresponding first recessed section 14 of the abutment plate 5 are specifically designed in order to achieve easier releasability. Thus, the curved operative surface 40 of the first clamping part 10 has a radius of curvature $r_K$, of which the centre point is offset with respect to the first pivot axis 13 and which is preferably somewhat smaller than a radius of curvature $R_K$ of the first recessed section 14. Both the curved operative surface 40 and the first recessed section 14 are preferably cylindrical and, in this case, have the radii r and R but it is also possible to select surfaces with different curvatures in both cases. If other curvatures are selected, then the curved operative surface has (in a mathematical sense) a multiplicity of (locally) different radii of curvature $r_K$, whereby the centre points of curvature thereof are offset with respect to the first pivot axis 13.

In order to achieve the easier releasability of the band clamp, the departure point is that the band clamp should be formed, in the actual clamping region, such that the point or the zone of engagement of the principally active clamping force shifts, during a pivot movement of the clamping part, on the operative surface of the clamping part in a direction which is counter to the pivot movement. This is achieved essentially by the first clamping part 10 being shaped as has been mentioned above. If it is assumed that the abovementioned point of engagement is that point on the operative surface 40 of the first clamping part 10 where the distance from the mating operative surface of the first recessed section is the smallest at any one point in time, the torque action of the band tensile force S produces the principally active clamping force $N_K$ at this point of engagement. It is assumed here that the point of engagement, in the example of FIG. 6, first of all be located on the vertex of the curved operative surface 40.

Figure 7:
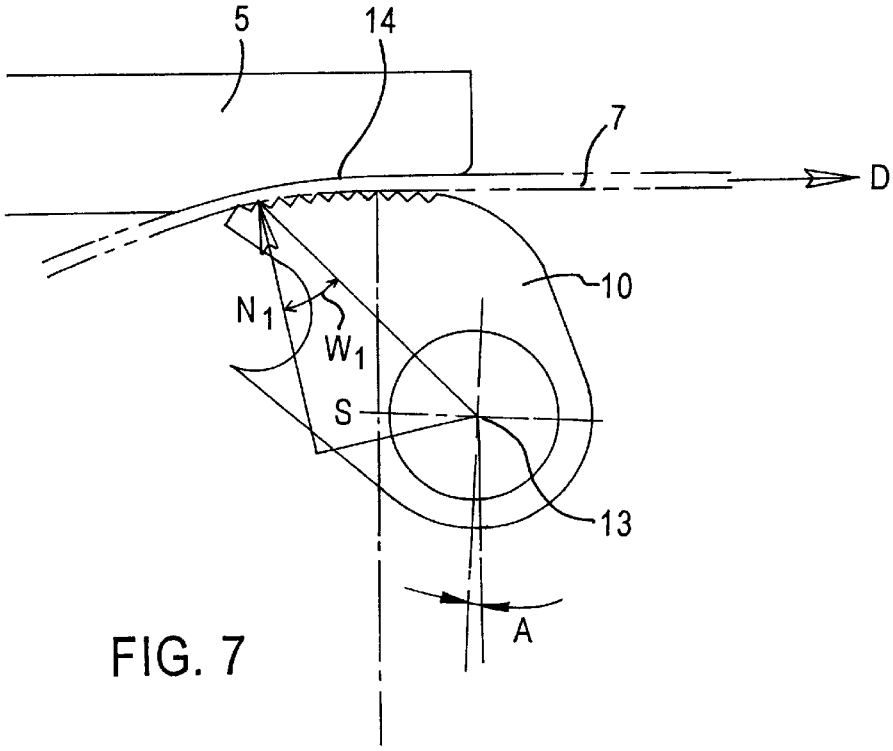
FIG. 7 depicts the band clamp at the end of the tensioning operation.

Finally, FIG. 7 shows a band clamp after the tensioning force or band tensile force S has been applied. The band tensile force S applied acts in direction D. The band tensile force S rotates the first clamping part 10 in the clockwise direction through the angle A. This rotation is produced by a certain elasticity of the first band clamp 15 and of the plastic band 7, this elasticity always being present. In the example shown, the point of engagement of the principally active clamping force shifts on the curved operative surface 40 to the left, in the anticlockwise direction.

The triangles of forces which are produced at the respective points of engagement are depicted in FIGS. 6 and 7. The active forces here are the band tensile force S (tangential at the point of engagement) and the principally active clamping force $N_K$ (normal to the point of engagement), which may also be taken as a measure of the release force which is to be applied. In this case, the following equation holds true:

$$N_K=S\cdot\cot(W_K)$$

where $W_K$ is the clamping angle.

The following equation thus holds true for FIG. 6:

$$N=S\cdot\cot(W)$$

Accordingly, the following equation holds true for FIG. 7:

$$N_1=S\cdot\cot(W_1)$$

It can be seen from the geometrical relationships of the triangles of forces that the clamping angle $W_1$ in the triangle of forces of FIG. 7 is larger than the clamping angle W in the triangle of forces of FIG. 6, and that, accordingly, the release force which is to be applied, and which corresponds to the clamping force $N_K$ (produced by self-locking), decreases as the clamping angle $W_K$ increases. The geometrical shaping of the clamping parts 10 and 16 and of the recessed sections 14 and 18 of the abutment plate 5 are thus advantageously selected such that the clamping angle $W_K$ can be as large as possible. For this purpose, the angle range covered by the curved operative surface 40 of the clamping part 10 has to be selected to be as large as possible. The curved operative surface of the clamping part is also advantageously provided with a fine toothing arrangement, in order that the clamping part grips in a reliable manner even in the case of a large clamping angle. Of course, it is also possible for both the operative surfaces of the clamping parts and the mating operative surfaces of the corresponding recessed sections in the abutment plate to be provided with toothing arrangements.

The arrangement of the movable components allows, in addition, particularly compact and straightforward construction of the closure unit 4. This is achieved, in particular, by the arrangement of the welding tongue 34 and of the band cutter 11 on opposite sides of the pivot housing 30, it being the case that either the welding tongue 34 or the band cutter 11 is pivoted in beneath the abutment plate 5 during the closure operation. This reduces the overall height. For the purpose of releasing the closed band 7, it is also possible for the pivot housing 30, with the abutment plate 5, to be pivoted out.

Furthermore, the closure-unit construction shown makes it possible to have increased safety for the operators. The side views of FIGS. 2B to 5B show that the welding tongue 34 is largely covered by the abutment plate 5 in the initial state and is even fully covered by the abutment plate 5 during the welding operation and the release of the closed band. That part of the welding tongue which comes into contact with the plastic band is always covered by the abutment plate 5.

What is claimed is:

1. Apparatus for strapping packages (1) with a weldable band (7), comprising a band-supply unit (2), a band-transporting and -tensioning unit (3), a closure unit (4) Provided as a separate unit and having an abutment plate (5), and a band-guidance unit (6), said closure unit further including at least one band clamp (15, 19) with a pivotably mounted clamping part (10, 16) and a curved operative surface (40) being provided, wherein the band clamp (15, 19) is self-locking, wherein, between a shaped section (14, 18) of the abutment plate (5) and the operative surface (40) of the clamping part (10, 16), the band clamp (15, 19) has, in a region for clamping the band (7), a point or a zone of engagement which shifts, during pivotal movement of the clamping part (10, 16), on the operative surface (40) of the clamping part (10, 16) in a direction which is counter to the pivotal movement, the point or the zone of engagement being the location or the region where the distance between the shaped section (14, 18) of the abutment plate (5) and the operative surface (40) of the clamping part (10, 16) is smallest, wherein the curved operative surface (40) of the clamping part (10, 16) has at least one radius of curvature $r_K$, of which the centre point is offset with respect to a pivot axis (13, 17) of the clamping part (10, 16), said radius of curvature $r_K$being smaller than a radius of curvature $R_K$ of the shaped section (14, 18) of the abutment plate (5).

2. Apparatus for strapping packages (1) with a weldable band (7), comprising a band-supply unit (2), a band-transporting and -tensioning unit (3), a closure unit (4) provided as a separate unit and having an abutment plate (5), and a band-guidance unit (6), said closure unit further including at least one band clamp (15, 19) with a pivotably mounted clamping part (10, 16) and a curved operative surface (40) being provided, wherein the band clamp (15, 19) is self-locking, wherein, between a shaped section (14, 18) of the abutment plate (5) and the operative surface (40) of the clamping part (10, 16), the band clamp (15, 19) has, in a region for clamping the band (7), a point or a zone of engagement which shifts, during pivotal movement of the clamping part (10, 16), on the operative surface (40) of the clamping part (10, 16) in a direction which is counter to the pivotal movement, the point or the zone of engagement being the location or the region where the distance between the shaped section (14, 18) of the abutment plate (5) and the operative surface (40) of the clamping part (10, 16) is smallest, wherein the curved operative surface (40) of the clamping part (10, 16), is circular and is provided with a radius of curvature r, the radius of curvature r being smaller than the radius of curvature R of the shaped section (14, 18) of the abutment plate (5).

3. Apparatus according to claim 2, wherein the curved operative surface (40) of the clamping part (10, 16) is toothed at least in the region of a point or a zone of engagement.

4. Apparatus according to claim 2, wherein the clamping part (10, 16) is mounted on a pivot housing (30) which is fixedly connected to the abutment plate (5).

5. Apparatus for strapping packages (1) with a weldable band (7), comprising a band-supply unit (2), a band-transporting and -tensioning unit (3), a closure unit (4) provided as a separate unit and having an abutment plate (5), and a band-guidance unit (6), said closure unit further including at least one band clamp (15, 19) with a pivotably mounted clamping part (10, 16) and a curved operative surface (40) being provided, wherein the band clamp (15, 19) is self-locking, further comprising a pivotably mounted closure plate (27) for cooperating with the abutment plate to weld the band, wherein said closure plate (27) is operatively arranged, in a rest position, obliquely with respect to a pressure-exerting surface of the abutment plate (5) to facilitate introduction of the band (7).

6. Apparatus according to claim 5, wherein the closure plate (27) is pivotable towards the abutment plate (5) into an actuating position.

7. Apparatus for strapping packages (1) with a weldable band (7), comprising a band-supply unit (2), a band-transporting and -tensioning unit (3), a closure unit (4) provided as a separate unit and having an abutment plate (5), and a band-guidance unit (6), said closure unit further including at least one band clamp (15, 19) with a pivotably mounted clamping part (10, 16) and a curved operative surface (40) being provided, wherein the band clamp (15, 19) is self-locking, and further comprising a welding tongue (34) and a band cutter (11) each mounted for pivotal movement beneath the abutment plate (5), and wherein a part of the welding tongue (34) contactable with the band (7) is always juxtaposed beneath the abutment plate (5).

* * * * *